US009130256B2

(12) United States Patent
Rogozine et al.

(10) Patent No.: US 9,130,256 B2
(45) Date of Patent: Sep. 8, 2015

(54) DIELECTRIC WAVEGUIDE FILTER WITH DIRECT COUPLING AND ALTERNATIVE CROSS-COUPLING

(71) Applicants: Alexandre Rogozine, Rio Rancho, NM (US); Reddy Vangala, Albuquerque, NM (US)

(72) Inventors: Alexandre Rogozine, Rio Rancho, NM (US); Reddy Vangala, Albuquerque, NM (US)

(73) Assignee: CTS CORPORATION, Elkhart, IN (US)

( * ) Notice: Subject to any disclaimer, the term of this patent is extended or adjusted under 35 U.S.C. 154(b) by 0 days.

(21) Appl. No.: 14/289,849

(22) Filed: May 29, 2014

(65) Prior Publication Data

US 2014/0266514 A1 Sep. 18, 2014

Related U.S. Application Data

(63) Continuation-in-part of application No. 13/373,862, filed on Dec. 3, 2011, and a continuation-in-part of application No. 13/103,712, filed on May 9, 2011, now Pat. No. 8,823,470.

(60) Provisional application No. 61/830,476, filed on Jun. 3, 2013.

(51) Int. Cl.
*H01P 1/20* (2006.01)
*H01P 7/10* (2006.01)
(Continued)

(52) U.S. Cl.
CPC ..... *H01P 1/2002* (2013.01); *H01P 1/207* (2013.01); *H01P 1/208* (2013.01); *H01P 1/2088* (2013.01); *H01P 7/10* (2013.01)

(58) Field of Classification Search
CPC ..... H01P 1/2002; H01P 1/2088; H01P 7/10
USPC ..... 333/202–212, 219.1
See application file for complete search history.

(56) References Cited

U.S. PATENT DOCUMENTS 3,882,434 A * 5/1975 Levy ..... 333/212
4,396,896 A 8/1983 Williams
(Continued)

FOREIGN PATENT DOCUMENTS

CN 201898182 U 7/2011
CN 102361113 A 2/2012
(Continued)

OTHER PUBLICATIONS

Ruiz-Cruz J et al: "Rectangular Waveguide Elliptic Filters with Capacitive and Inductive Irises and Integrated Coaxial Excitation", 2005 IEEE MTT-S International Microwave Symposium, Piscataway, NJ, USA, IEEE, (Jun. 12, 2005) pp. 269-272, EP010844740, DOI: 10.1109/MWSYM.2005.1516577, ISBN: 978-0-7803-8846-8 p. 269; figures 1,3.
(Continued)

*Primary Examiner* — Benny Lee
*Assistant Examiner* — Rakesh Patel
(74) *Attorney, Agent, or Firm* — Daniel J. Deneufbourg

(57) ABSTRACT

A dielectric waveguide filter which, in one embodiment, is comprised of a plurality of monoblocks coupled together in a side-by-side relationship. In one embodiment, the waveguide filter includes two end monoblocks and two interior monoblocks each defining two resonators. First and second RF signal input/output electrodes are defined on the two end monoblocks. In one embodiment, a direct RF signal transmission path is defined in part by the combination of the resonators, RF signal transmission bridges on each of the monoblocks that interconnect the resonators on each of the monoblocks, and RF signal transmission windows between and interconnecting the resonators of adjacent monoblocks. In one embodiment, alternate or cross-coupling RF signal transmission paths are defined by external RF signal transmission lines that extend between adjacent monoblocks.

13 Claims, 7 Drawing Sheets

(51) Int. Cl.
*H01P 1/207* (2006.01)
*H01P 1/208* (2006.01)

(56) References Cited

U.S. PATENT DOCUMENTS

| | | | |
|---|---|---|---|
| 4,431,977 | A | 2/1984 | Sokola et al. |
| 4,609,892 | A | 9/1986 | Higgins, Jr. |
| 4,692,726 | A | 9/1987 | Green et al. |
| 4,706,051 | A | 11/1987 | Dieleman et al. |
| 4,733,208 | A | 3/1988 | Ishikawa et al. |
| 4,742,562 | A | 5/1988 | Kommrusch |
| 4,800,348 | A | 1/1989 | Rosar et al. |
| 4,806,889 | A | 2/1989 | Nakano et al. |
| 4,837,535 | A | 6/1989 | Konishi et al. |
| 4,940,955 | A | 7/1990 | Higgins, Jr. |
| 4,963,844 | A | 10/1990 | Konishi et al. |
| 4,996,506 | A | 2/1991 | Ishikawa et al. |
| 5,004,992 | A | 4/1991 | Grieco et al. |
| 5,023,944 | A | 6/1991 | Bradley |
| 5,130,682 | A | 7/1992 | Agahi-Kesheh |
| 5,208,565 | A | 5/1993 | Sogo et al. |
| 5,243,309 | A | 9/1993 | L'Ecuyer |
| 5,285,570 | A | 2/1994 | Fulinara |
| 5,288,351 | A | 2/1994 | Hoang et al. |
| 5,365,203 | A | 11/1994 | Nakamura et al. |
| 5,382,931 | A | 1/1995 | Piloto et al. |
| 5,416,454 | A | 5/1995 | McVeety |
| 5,525,946 | A | 6/1996 | Tsujiguchi et al. |
| 5,528,204 | A | 6/1996 | Hoang et al. |
| 5,528,207 | A | 6/1996 | Ito |
| 5,537,082 | A | 7/1996 | Tada et al. |
| 5,572,175 | A | 11/1996 | Tada et al. |
| 5,602,518 | A | 2/1997 | Clifford, Jr. et al. |
| 5,719,539 | A | 2/1998 | Ishizaki et al. |
| 5,731,751 | A | 3/1998 | Vangala |
| 5,821,836 | A | 10/1998 | Katehi et al. |
| 5,850,168 | A | 12/1998 | McVetty et al. |
| 5,926,078 | A | 7/1999 | Hino et al. |
| 5,926,079 | A | 7/1999 | Heine et al. |
| 5,929,726 | A | 7/1999 | Ito et al. |
| 5,999,070 | A | 12/1999 | Endo |
| 6,002,306 | A | 12/1999 | Arakawa |
| 6,023,207 | A | 2/2000 | Ito et al. |
| 6,137,383 | A | 10/2000 | De Lillo |
| 6,154,106 | A | 11/2000 | De Lillo |
| 6,160,463 | A | 12/2000 | Arakawa et al. |
| 6,181,225 | B1 | 1/2001 | Bettner |
| 6,255,921 | B1 | 7/2001 | Arakawa et al. |
| 6,281,764 | B1 | 8/2001 | Arakawa et al. |
| 6,329,890 | B1 | 12/2001 | Brooks et al. |
| 6,351,198 | B1 | 2/2002 | Tsukamoto et al. |
| 6,437,655 | B1 | 8/2002 | Andoh et al. |
| 6,504,446 | B1 | 1/2003 | Ishihara et al. |
| 6,535,083 | B1 | 3/2003 | Hageman et al. |
| 6,549,095 | B2 | 4/2003 | Tsukamoto et al. |
| 6,559,740 | B1 | 5/2003 | Schulz et al. |
| 6,568,067 | B2 | 5/2003 | Takeda |
| 6,594,425 | B2 | 7/2003 | Tapalian et al. |
| 6,677,837 | B2 | 1/2004 | Kojima et al. |
| 6,757,963 | B2 | 7/2004 | Meier et al. |
| 6,791,403 | B1 | 9/2004 | Tayrani et al. |
| 6,801,106 | B2 | 10/2004 | Ono et al. |
| 6,834,429 | B2 | 12/2004 | Blair et al. |
| 6,844,861 | B2 | 1/2005 | Peterson |
| 6,888,973 | B2 | 5/2005 | Kolodziejski et al. |
| 6,900,150 | B2 | 5/2005 | Jacquin et al. |
| 6,909,339 | B2 | 6/2005 | Yonekura et al. |
| 6,909,345 | B1 | 6/2005 | Salmela et al. |
| 6,927,653 | B2 | 8/2005 | Uchimura et al. |
| 6,977,560 | B2 | 12/2005 | Itoh et al. |
| 6,977,566 | B2 | 12/2005 | Fukunaga |
| 7,009,470 | B2 | 3/2006 | Yatabe et al. |
| 7,068,127 | B2 | 6/2006 | Wilber et al. |
| 7,132,905 | B2 | 11/2006 | Sano |
| 7,142,074 | B2 | 11/2006 | Kim et al. |
| 7,170,373 | B2 | 1/2007 | Ito et al. |
| 7,271,686 | B2 | 9/2007 | Yoshikawa et al. |
| 7,323,954 | B2 | 1/2008 | Lee et al. |
| 7,449,979 | B2 | 11/2008 | Koh et al. |
| 7,545,235 | B2 | 6/2009 | Mansour et al. |
| 7,659,799 | B2 | 2/2010 | Jun et al. |
| 7,714,680 | B2 | 5/2010 | Vangala et al. |
| 8,008,993 | B2 | 8/2011 | Milsom et al. |
| 8,072,294 | B2 | 12/2011 | Tanpo et al. |
| 8,171,617 | B2 | 5/2012 | Vangala |
| 8,284,000 | B2 | 10/2012 | Fukunaga |
| 8,314,667 | B2 | 11/2012 | Uhm et al. |
| 8,823,470 | B2 | 9/2014 | Vangala |
| 2001/0024147 | A1 | 9/2001 | Arakawa et al. |
| 2002/0024410 | A1 | 2/2002 | Guglielmi et al. |
| 2003/0006865 | A1 | 1/2003 | Kim et al. |
| 2004/0000968 | A1 | 1/2004 | White et al. |
| 2004/0056737 | A1 | 3/2004 | Carpintero et al. |
| 2004/0129958 | A1 | 7/2004 | Koh et al. |
| 2004/0257194 | A1 | 12/2004 | Casey et al. |
| 2005/0057402 | A1* | 3/2005 | Ohno et al. ..... 343/700 MS |
| 2007/0120628 | A1 | 5/2007 | Jun et al. |
| 2009/0015352 | A1 | 1/2009 | Goebel et al. |
| 2009/0102582 | A1 | 4/2009 | Van Der Heijden et al. |
| 2009/0146761 | A1 | 6/2009 | Nummerdor |
| 2009/0201106 | A1 | 8/2009 | Iio et al. |
| 2009/0231064 | A1 | 9/2009 | Bates et al. |
| 2010/0024973 | A1 | 2/2010 | Vangala |
| 2010/0253450 | A1 | 10/2010 | Kim et al. |
| 2011/0279200 | A1 | 11/2011 | Vangala |
| 2012/0229233 | A1 | 9/2012 | Ito |
| 2012/0286901 | A1 | 11/2012 | Vangala |
| 2013/0214878 | A1 | 8/2013 | Gorisee et al. |

FOREIGN PATENT DOCUMENTS

| | | | |
|---|---|---|---|
| DE | 102008017967 | A1 | 10/2009 |
| EP | 0322993 | A2 | 7/1989 |
| EP | 0322993 | A3 | 4/1990 |
| EP | 0444948 | A2 | 3/1991 |
| EP | 0757401 | A2 | 2/1997 |
| EP | 0859423 | A1 | 8/1998 |
| EP | 1024548 | A1 | 2/2000 |
| EP | 0997964 | A2 | 5/2000 |
| EP | 0997964 | A3 | 9/2001 |
| EP | 1439599 | A1 | 7/2004 |
| FR | 2318512 | A1 | 2/1977 |
| JP | 62038601 | | 2/1987 |
| JP | 2003298313 | | 10/2003 |
| WO | 9509451 | | 4/1995 |
| WO | 0024080 | | 4/2000 |
| WO | 2005091427 | | 9/2005 |

OTHER PUBLICATIONS

Paul Wade: "Rectangular Waveguide to Coax Transition Design", QEX, Nov./Dec. 2006, pp. 10-17, published by American Radio Relay League, Newington, Connecticut, US.

Yoji Isota, Moriyasu Miyazaki, Osami Ishida, Fumio Takeda, Mitsubishi Electric Corporation. "A Grooved Monoblock Comb-Line Filter Suppressing the Third Harmonics", IEEE 1987 MTT-S Digest, pp. 383-386, published by IEEE, New York, New York, US.

C. Choi, Fig. 2.13, Monolithic Plated Ceramic Waveguide Filters, Mar. 31, 1986, Motorola, Inc., Schaumburg, Illinois, U.S.

Kocbach J. et al: "Design Procedure for Waveguide Filters with Cross-Couplings", 2002 IEEE MTT-S International Microwave Symposium Digest (Cat. No. 02CH37278) IEEE Piscataway, NJ, USA; IEEE MTT-S International Microwave Symposium, IEEE, Jun. 2, 2002, pp. 1449-1452, XP001113877, DOI: 10.1109/WMSYM.2002.1012128 ISBN: 978-0-8703-7239-9 abstract; figure 1.

N. Marcuvitz, Waveguide Handbook, McGraw-Hill Book Co., New York City, Ch. 5, 1951.

Y. Konishi, "Novel dielectric waveguide components-microwave applications of new ceramic materials," Proc. IEEE, vo. 79, pp. 726-740, Jun. 1991.

(56) References Cited

OTHER PUBLICATIONS

K. Sano, "Dielectric waveguide filter with low profile and low insertion loss," IEEE Trans. on Microwave Theory & Tech., vol. 47, pp. 2299-2303, Dec. 1999.

K. Sano and T. Yoneyama, "A transition from Microstrip to Dielectric Filled Rectangular Waveguide in Surface Mounting," IEEE MTT-S Int. Microwave Symp. Digest, pp. 813-816, 2002.

I. Awai, A.C. Kundu, and T. Yamashita, "Equivalent circuit representation and explanation of attenuation poles of a dual-mode dielectric resonator bandpass filter," IEEE Trans. Microwave Theory & Tech., vol. 46, pp. 2159-2163, Dec. 1998.

A.D. Paidus and C. Rossiter, "Cross-coupling in microwave bandpass filters," Microwave Journal, pp. 22-46, Nov. 2004.

Tze-min Shen; Chi-Feng Chen' Huang, Ting-Yi; Wu, Ruey-Beei, "Design of Vertically Stacked Waveguide Filters in LTCC," Microwave Theory and Techniques, IEEE Transactions on, vol. 55, No. 8, pp. 1771,1779, Aug 2007.

Hung-Yi Chien; Tze-Min Shen; Huang; Ting-Yi; Wei-Hsin Wang; Wu, Ruey-Beei, "Miniaturized Bandpass Filters with Double-Folded Substrate Integrated Resonators in LTCC," Microwave Theory and Techniques, IEEE Transactions on vol. 57, No. 7, pp. 1774, 1782, Jul. 2009.

Bo-Jiun Chen; Tze-Min Shen; Wu, Ruey-Beei, "Dual Band Vertically Stacked Laminated Waveguide Filter Design in LTCC Technology," Microwave Theory and Techniques, IEEE Transactions on, vol. 57, No. 6, pp. 1554, 1562, Jun. 2009.

Wolfram Wersing, Microwave ceramics for resonators and filters, Current Opinion in Solid State and Materials Science, vol. 1, Issue 5, Oct. 1996, pp. 715-731, ISSN 1359-0286.

Shen T et al, Full-Wave Design of Canonical Waveguide Filters by Optimation, 2001 IEEE MTT-S International Microwave Symposium Digest. (IMS 2001) Phoenix, AZ, May 20-25, 2001, pp. 1487-1490.

John David Rhodes, The Generalized Direct-Coupled Cavity Linear Phase Filter, IEEE Transactions on Microwave Theory and Techniques, vol. MTT-18, No. 6, Jun. 1, 1970, pp. 308-313, XP001401320, abstract.

* cited by examiner

DIELECTRIC WAVEGUIDE FILTER WITH DIRECT COUPLING AND ALTERNATIVE CROSS-COUPLING

CROSS-REFERENCE TO RELATED AND CO-PENDING APPLICATIONS

This patent application is a continuation-in-part of, and claims the benefit of the filing date and disclosure of, U.S. patent application Ser. No. 13/373,862 filed on Dec. 3, 2011 and titled "Dielectric Waveguide Filter with Direct Coupling and Alternative Cross-Coupling" and U.S. patent application Ser. No. 13/103,712 filed on May 9, 2011 and titled "Dielectric Waveguide Filter with Structure and Method for Adjusting Bandwidth". This patent application also claims the benefit of the filing date and disclosure of U.S. Provisional Patent Application Ser. No. 61/830,476 filed on Jun. 3, 2013. These patent applications are explicitly incorporated herein by reference as are all references cited therein.

FIELD OF THE INVENTION

The invention relates generally to dielectric waveguide filters and, more specifically, to a dielectric waveguide filter with direct coupling and alternative cross-coupling.

BACKGROUND OF THE INVENTION

This invention is related to a dielectric waveguide filter of the type disclosed in U.S. Pat. No. 5,926,079 to Heine et al. in which a plurality of resonators are spaced longitudinally along the length of a monoblock of dielectric/ceramic material and in which a plurality of slots/notches are spaced longitudinally along the length of the monoblock and define a plurality of RF signal bridges of dielectric material between the plurality of resonators which provide a direct inductive/capacitive coupling between the plurality of resonators.

The attenuation characteristics of a waveguide filter of the type disclosed in U.S. Pat. No. 5,926,079 to Heine et al. can be increased through the incorporation of zeros in the form of additional resonators located at one or both ends of the waveguide filter. A disadvantage associated with the incorporation of additional resonators, however, is that it also increases the length of the filter which, in some applications, may not be desirable or possible due to, for example, space limitations on a customer's motherboard.

The attenuation characteristics of a filter can also be increased by both direct and cross-coupling of the resonators as disclosed in, for example, U.S. Pat. No. 7,714,680 to Vangala et al. which discloses a monoblock filter with both inductive direct coupling and quadruplet cross-coupling of resonators created in part by respective metallization patterns which are defined on the top surface of the filter and extend between selected ones of the resonator through-holes to provide the disclosed direct and cross-coupling of the resonators.

Direct and cross-coupling of the type disclosed in U.S. Pat. No. 7,714,680 to Vangala et al. and comprised of top surface metallization patterns is not applicable in waveguide filters of the type disclosed in U.S. Pat. No. 5,926,079 to Heine et al. which includes only slots and no top surface metallization patterns.

The present invention is thus directed to a dielectric waveguide filter with both direct and optional or alternative cross-coupled resonators which allow for an increase in the attenuation characteristics of the waveguide filter without an increase in the length of the waveguide filter.

SUMMARY OF THE INVENTION

The present invention is directed to a waveguide filter comprising a pair of end blocks each defining at least a pair of resonators and an RF signal transmission input/output transmission electrode, one or more interior RF signal transmission blocks each defining at least a pair of resonators and located between the pair of end blocks, at least one RF signal transmission bridge defined on each of the end and interior blocks between and interconnecting the pair of resonators, and a plurality of interior RF signal transmission windows defined between each of the end and interior blocks, the combination of the RF signal input/output electrodes, the plurality of resonators, the RF signal transmission bridges, and the RF signal transmission windows together defining a direct path for the transmission of an RF signal through the waveguide filter.

In one embodiment, the end and interior blocks comprise separate blocks of dielectric material coupled together in a side-by-side relationship.

In one embodiment, the exterior surface of the end and interior blocks are covered with a layer of conductive material, the plurality of interior RF signal transmission windows being defined by regions of the exterior surface of the end and interior blocks which are devoid of conductive material.

In one embodiment, the plurality of interior RF signal transmission windows are defined and located between the end and interior blocks.

In one embodiment, an external RF signal transmission line extends between the pair of end blocks and the interior blocks for providing a cross-coupling RF signal transmission path between the interior blocks and the pair of end blocks.

In one embodiment, each of the end and interior blocks defines at least one slit in co-linear relationship with the RF signal transmission bridge.

In one embodiment, the plurality of RF signal transmission windows are positioned between the end and interior blocks in an alternating and staggered relationship wherein the RF signal is transmitted through the waveguide filter in a serpentine pattern.

The present invention is also directed to a dielectric waveguide filter comprising a block of dielectric material defining a plurality of resonators arranged in a side-by-side relationship along at least first and second orthogonal axes, first and second RF signal input/output electrodes defined on the block of dielectric material, a first direct RF signal path transmission path between the first and second RF signal input/output electrodes, the first direct RF signal transmission path extending in the direction of the first and second axes, and a first indirect RF signal transmission path between the first and second RF signal input/output electrodes, the first indirect RF signal transmission path extending in the direction of the second axis.

In one embodiment, the block of dielectric material defines a plurality of internal RF signal transmission windows defining at least a portion of the direct RF signal transmission path.

In one embodiment, the plurality of internal RF signal transmission windows are arranged in an alternating relationship on opposite sides of the longitudinal axis of the waveguide filter to define a generally serpentine-shaped first direct RF signal transmission path.

In one embodiment, an external transmission line and the block of dielectric material define the first indirect RF signal transmission path.

In one embodiment, the block of dielectric material is comprised of a plurality of separate blocks of dielectric material coupled together in a side-by-side relationship and the first and second orthogonal axes comprise the x and y axis.

The present invention is further directed to a dielectric waveguide filter comprising first, second, third, and fourth blocks of dielectric material defining first, second, third, and fourth pluralities of resonators, the first, second, third, and fourth blocks of dielectric material being coupled together in an abutting side-by-side relationship, first, second, and third direct coupling RF signal transmission windows defined in the interior of the first, second, third, and fourth blocks of dielectric material for transmitting an RF signal from the first block of dielectric material to the fourth block of dielectric material, and first and second external transmission lines extending respectively between the first and second blocks of dielectric material and the third and fourth blocks of dielectric material for providing an indirect cross-coupling between the first and fourth blocks of dielectric material.

In one embodiment, the first and fourth blocks of dielectric material each define an RF signal input/output electrode, the RF signal transmission windows being arranged in a manner for transmitting the RF signal from the first block of dielectric material to the fourth block of dielectric material in a generally serpentine pattern.

In one embodiment, each of the RF signal input/output electrodes is defined by a through-hole extending through each of the first and fourth blocks of dielectric material and further comprising first, second, third, and fourth slots in the first, second, third, and fourth blocks of dielectric material aligned in a co-linear relationship to each other and the longitudinal axis of the waveguide filter and separating the respective first, second, third, and fourth pluralities of resonators.

Other advantages and features of the present invention will be more readily apparent from the following detailed description of the embodiments of the invention, the accompanying drawings, and the appended claims.

BRIEF DESCRIPTION OF THE DRAWING

These and other features of the invention can best be understood by the following description of the accompanying FIGURES as follows.

DETAILED DESCRIPTION OF THE EMBODIMENTS

Figure 1:
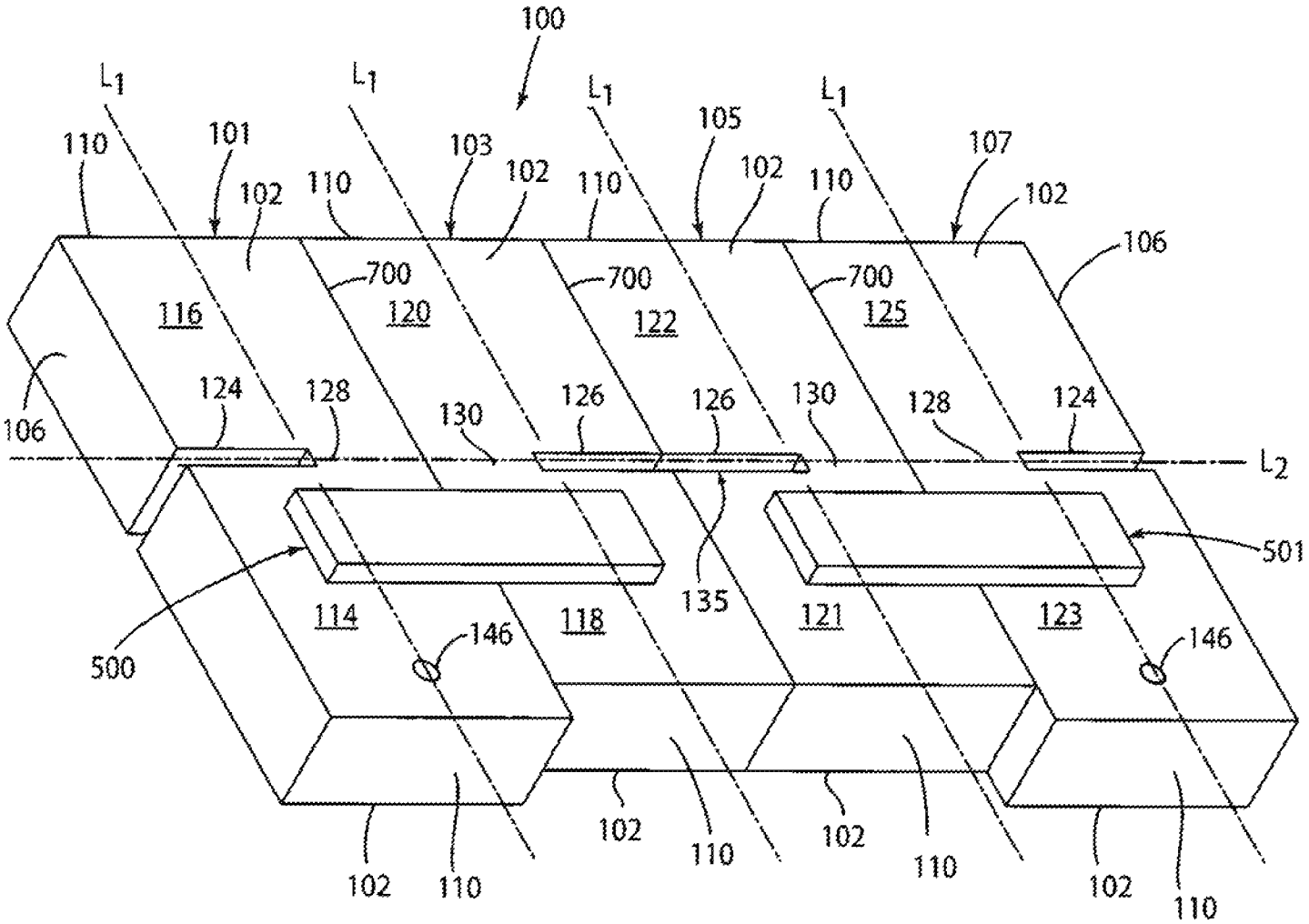
FIG. 1 is a perspective view of a dielectric waveguide filter according to the present invention.
Figure 2:
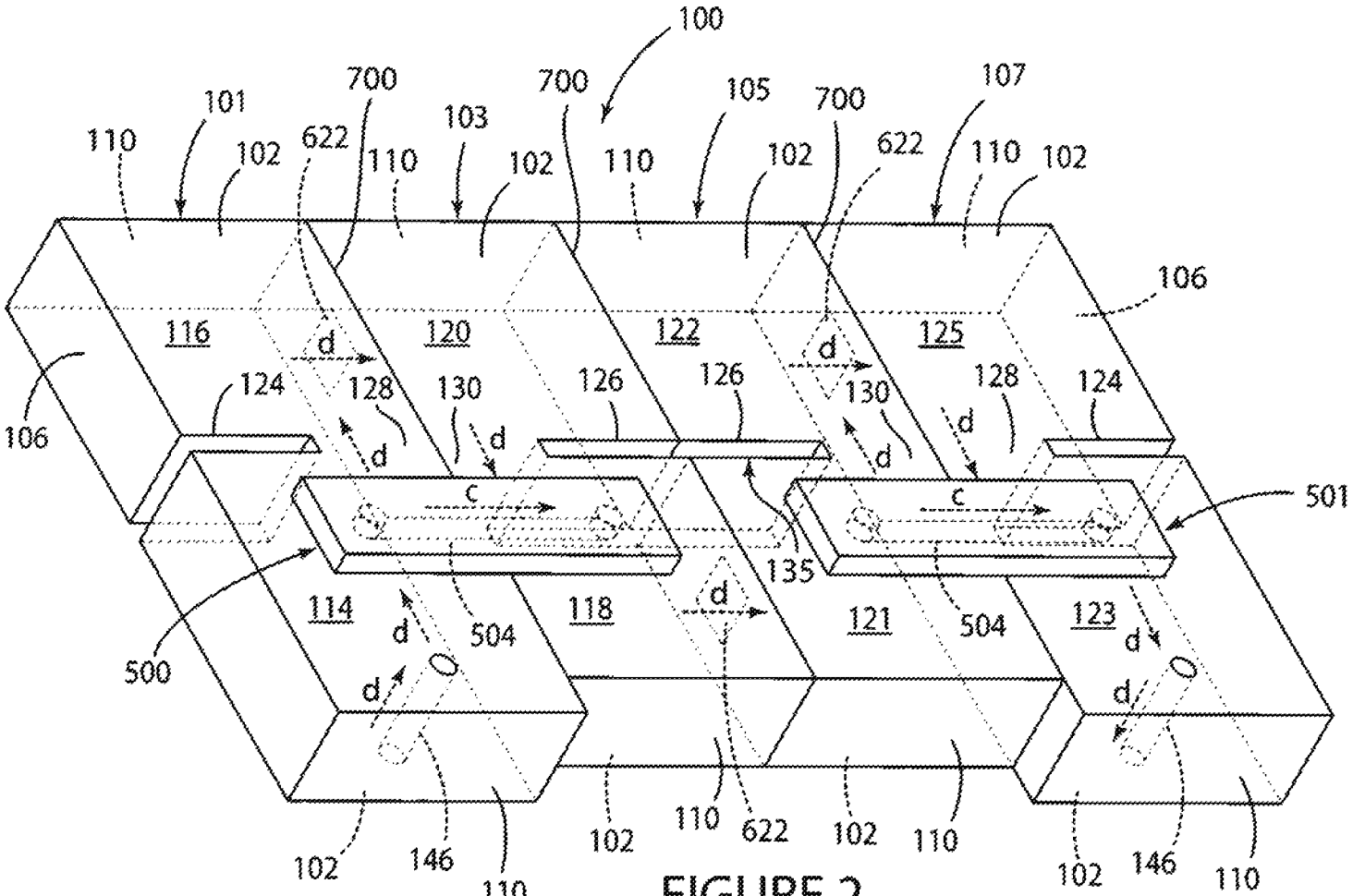
FIG. 2 is a part phantom perspective view of the dielectric waveguide filter shown in FIG. 1.
Figure 3:
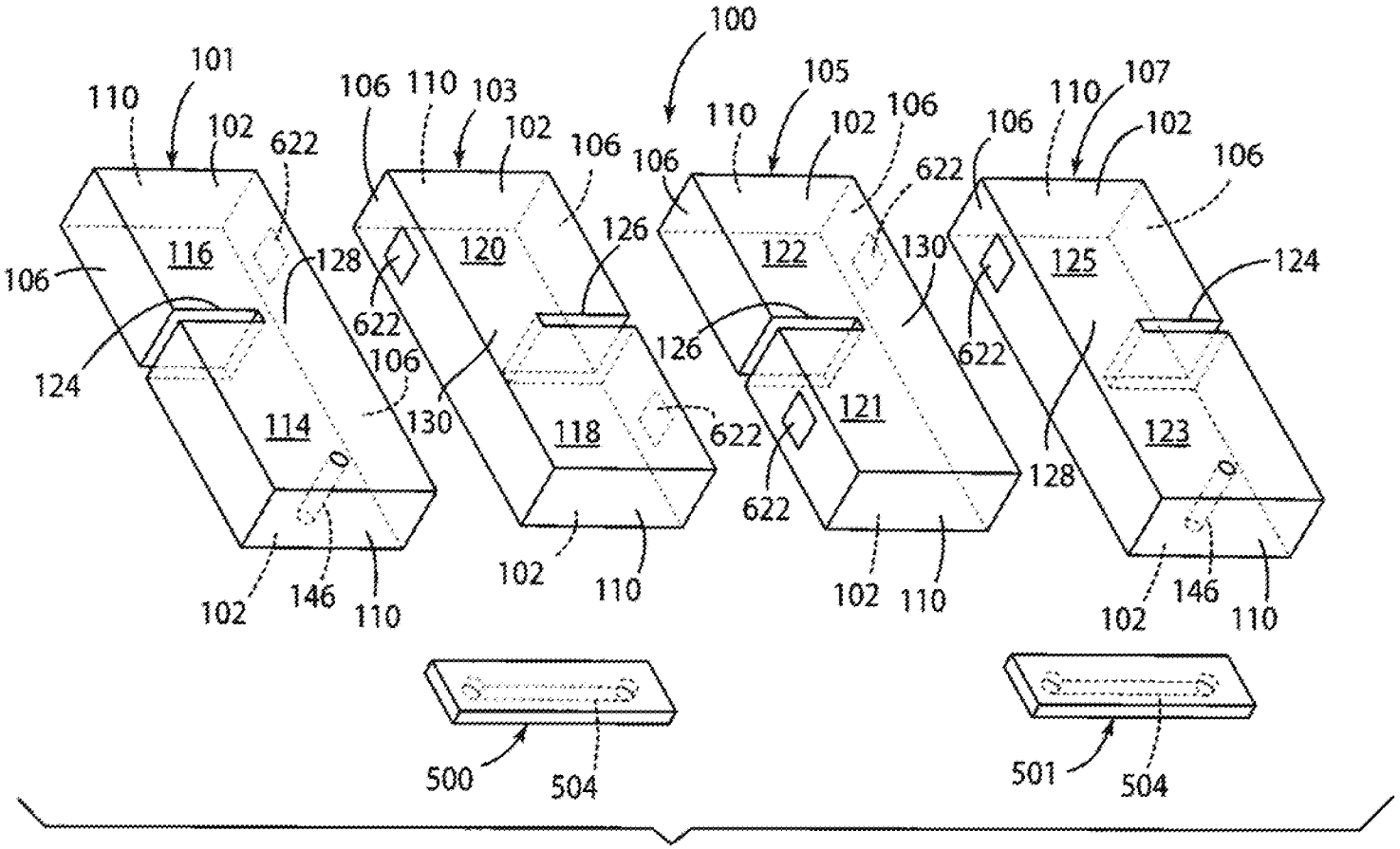
FIG. 3 is a part phantom, exploded perspective view of the dielectric waveguide filter shown in FIGS. 1 and 2.
Figure 4:
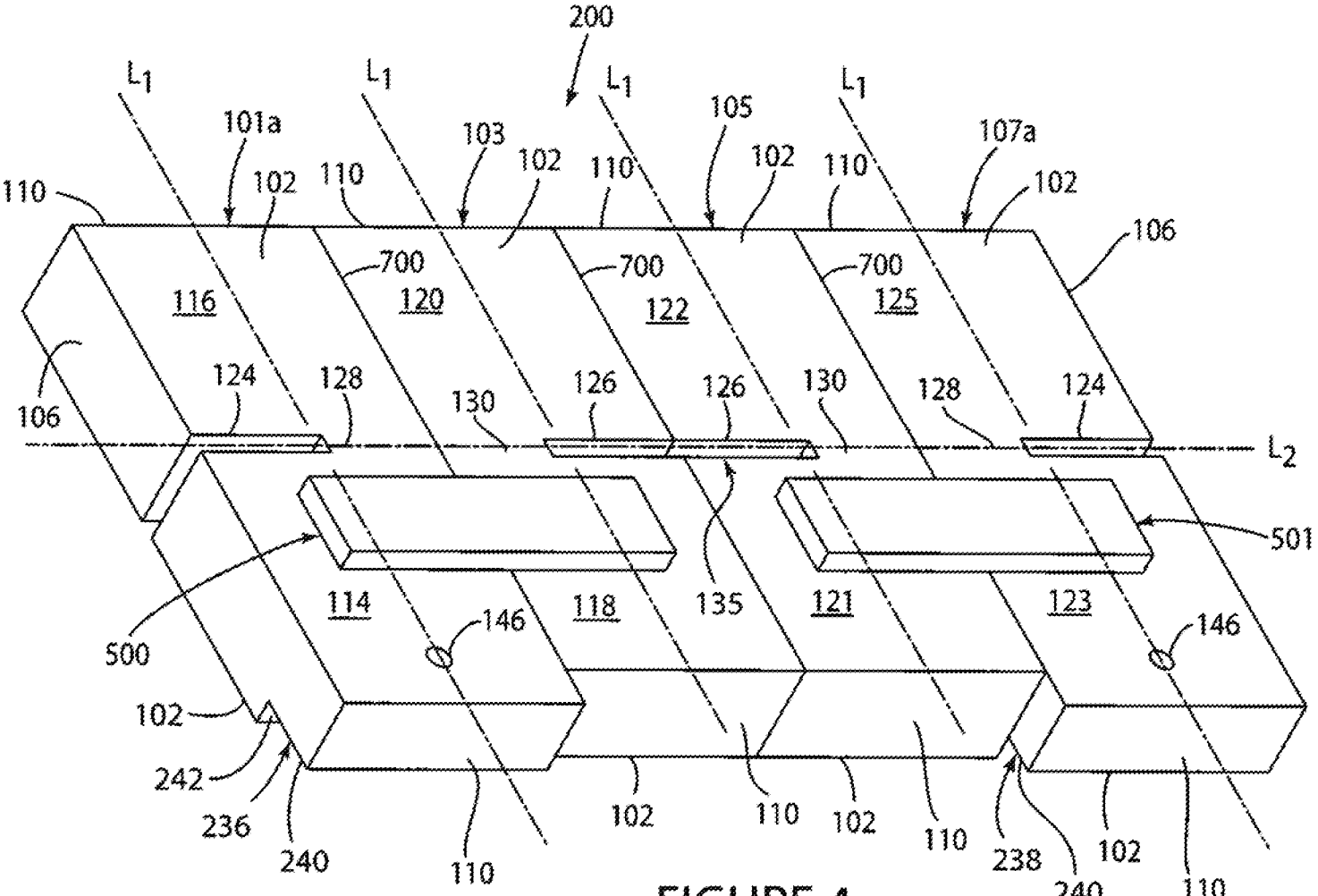
FIG. 4 is a perspective view of another embodiment of a dielectric waveguide filter according to the present invention.
Figure 5:
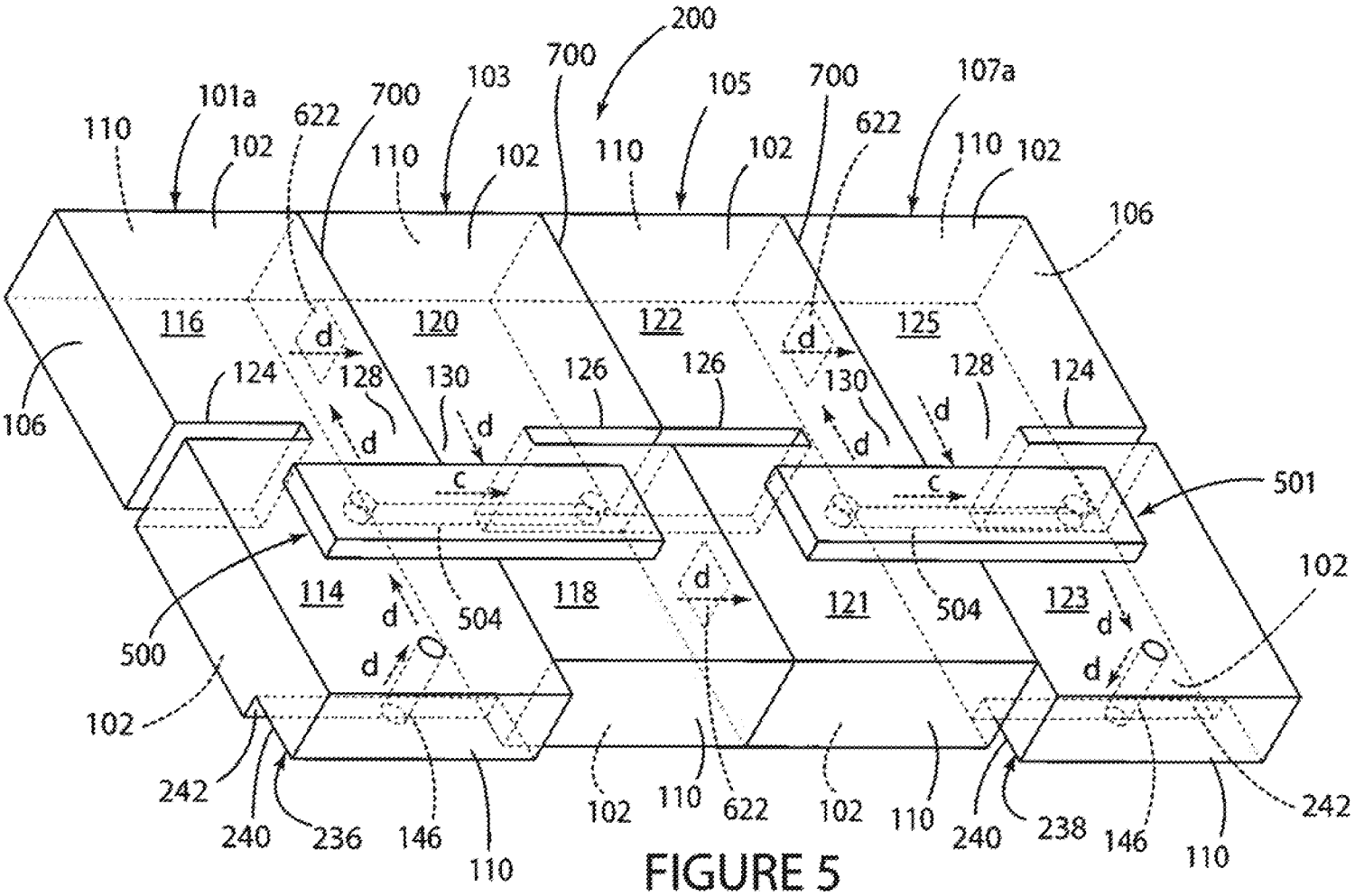
FIG. 5 is a part phantom perspective view of the dielectric waveguide filter shown in FIG. 4.
Figure 6:
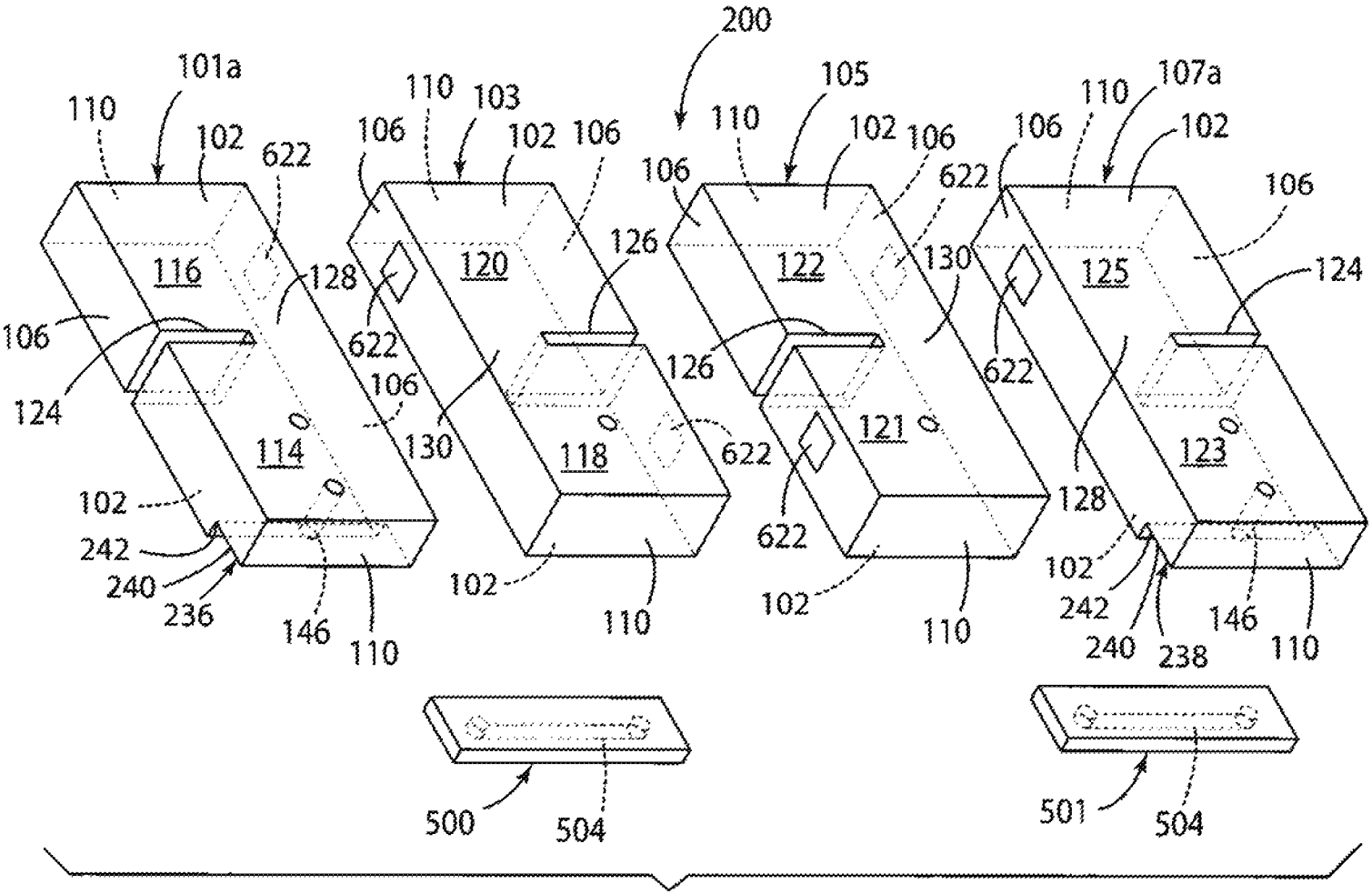
FIG. 6 is a part phantom, exploded perspective view of the dielectric waveguide filter shown in FIGS. 4 and 5.
Figure 7:
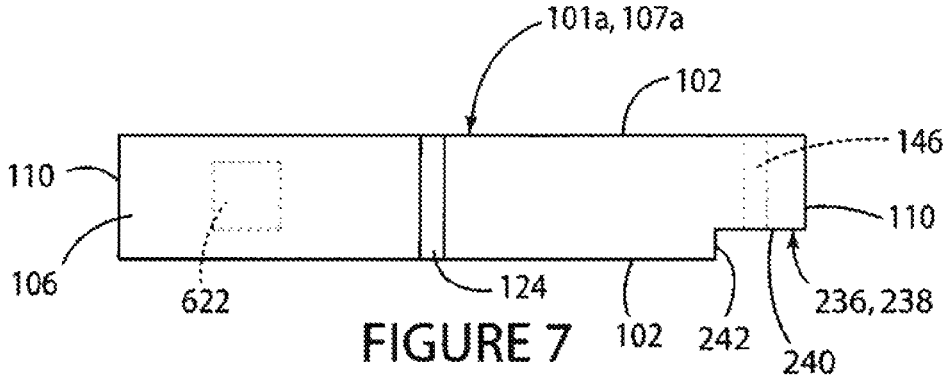
FIG. 7 is a side elevational view of one of the end blocks of the dielectric waveguide filter shown in FIGS. 4 and 5.

FIGS. 1, 2, and 3 depict one embodiment of an RF signal waveguide filter 100 in accordance with the present invention which, in the embodiment shown, is an 8-pole or resonator filter which incorporates both direct RF signal coupling and transmission features and characteristics and alternate cross-coupling/indirect RF signal coupling and transmission features and characteristics as discussed in more detail below.

The waveguide filter 100 is, in the embodiment of FIGS. 1, 2, and 3, made from four separate generally parallelepiped-shaped monoblocks or blocks 101, 103, 105, and 107 which have been coupled and secured together in a side-by-side relationship.

Each of the monoblocks or blocks 101, 103, 105, and 107 is comprised of a suitable dielectric material, such as for example ceramic; defines a longitudinal axis $L_1$(FIG. 1); includes opposed and spaced-apart longitudinal horizontal exterior surfaces 102 extending longitudinally in the same direction as the longitudinal axis $L_1$; opposed and spaced-apart longitudinal side vertical exterior surfaces 106 extending longitudinally in the same direction as the longitudinal axis $L_1$ and, more specifically, in a relationship on opposed sides of, spaced from, and parallel to, the longitudinal axis $L_1$; and opposed and spaced-apart transverse side vertical exterior end surfaces 110 extending in a direction generally normal to and intersecting the longitudinal axis $L_1$.

In the embodiment shown, all of the monoblocks have the same width and height; and the two end monoblocks 101 and 107 are of an equal length greater than the length of the two interior or intermediate monoblocks 103 and 105 which are of the same length.

The monoblocks 101, 103, 105, and 107 include respective pluralities of resonant sections (also referred to as cavities or cells or resonators) 114 and 116; 118 and 120; 121 and 122; and 123 and 125 which are spaced and extend longitudinally along the length and longitudinal axis $L_1$ of the respective monoblocks 101, 103, 105, and 107 and are separated from each other by a vertical slit or slot 124 (monoblocks 101 and 107) and a vertical slit or slot 126 (monoblocks 103 and 105) that are both cut into the respective monoblocks. An RF signal transmission bridge 128 (on the monoblocks 101 and 107) and an RF signal transmission bridge 130 (on the monoblocks 105 and 107) interconnects the respective resonators as discussed in more detail below.

Each of the slots 124 is cut through one of the longitudinal vertical exterior surfaces 106 and both of the upper and lower horizontal exterior surfaces 102 of the respective monoblocks 101 and 107. Each of the slots 124 extends in a relationship normal to and intersecting the longitudinal vertical exterior surface 106 and the longitudinal axis $L_1$ and terminates or ends in the body of the respective monoblocks 101 and 107 at a point short and spaced from the opposed longitudinal vertical exterior surface 106.

Each of the slots 130 is cut through one of the longitudinal vertical exterior surfaces 106 and both of the upper and lower horizontal exterior surfaces 102 of the respective monoblocks 103 and 105. Each of the slots 130 extends in a relationship normal to and intersecting the longitudinal vertical exterior surface 106 and the longitudinal axis $L_1$ and terminates or ends in the body of the respective monoblocks 103 and 105 at a point short and spaced from the opposed longitudinal vertical exterior surface 106.

Each of the slots 124 and 126 is co-linear with the respective RF signal transmission bridges 128 and 130 in the monoblocks 101 and 107 and 103 and 105 respectively. Each of the RF signal bridges 128 and 130 interconnect the pair of resonators on each of the respective monoblocks and are each comprised of a bridge or island of dielectric material which extends in the vertical direction between the top and bottom horizontal surfaces 102 of each of the monoblocks 101, 103, 105, and 107 and in the horizontal direction between the respective vertical exterior surface 106 and the end of the respective slots 124 and 126. In the embodiment shown, the respective slots 124 and 126 and the respective RF signal bridges 128 and 130 are oriented in a relationship generally normal to and on opposite sides of the longitudinal axis $L_1$ of the respective monoblocks 101, 103, 105, and 107.

Specifically, the RF signal transmission bridge 128 on the monoblock 101 bridges and interconnects the dielectric material of the resonator 114 to the dielectric material of the resonator 116; the RF signal transmission bridge 130 on the monoblock 103 bridges and interconnects the dielectric material of the resonator 118 to the dielectric material of the resonator 120; the RF signal transmission bridge 130 on the monoblock 105 bridges and interconnects the dielectric material of the resonator 121 to the dielectric material of the resonator 122; and the RF signal transmission bridge 128 on the monoblock 107 bridges and interconnects the dielectric material of the resonator 123 to the dielectric material of the resonator 125.

In the embodiment shown, the slots 126 and respective co-linear RF signal bridges 130 are generally centrally located on the respective monoblocks 103 and 105 and the length of each of the slots 124 and 126 is slightly greater than about half the width of the respective monoblocks 101, 103, 105, and 107 and thus the width of each of the respective co-linear RF signal transmission bridges 128 and 130 is slightly less than half of the width of each of the monoblocks 101, 103, 105, and 107.

Depending upon the application and desired performance characteristics, the width, length, and height of the slots 124 and 126 may be varied to vary, for example, the width of the respective RF signal bridges 128 and 130.

The monoblocks 101 and 107 additionally each comprise an electrical RF signal input/output electrode in the form of respective through-holes 146 which extend through the body of the respective monoblocks 101 and 107 in a direction normal to and co-linear with the longitudinal axis $L_1$ thereof and more specifically, through the body of the respective end resonators 114 and 123 defined in the respective monoblocks 101 and 107 and, in a relationship adjacent, spaced from, and parallel to, the transverse vertical end surface 110 of each of the respective monoblocks 101 and 107. In the embodiment shown, each of the monoblocks 101 and 107 includes only one through-hole 146 and defines only one RF signal input/output electrode in each of the monoblocks 101 and 107.

Still more specifically, the respective RF signal input/output through-holes 146 extend through the body of the respective monoblocks 101 and 107 in a direction and relationship generally normal to the upper and lower longitudinal horizontal exterior surfaces 102 and the longitudinal axis $L_2$ and more specifically in a relationship defining respective generally circular openings located and terminating in the upper and lower longitudinal horizontal exterior surfaces 102 of the respective monoblocks 101 and 107.

All of the external surfaces 102, 106, and 110 of the monoblocks 101, 103, 105, and 107, the internal surfaces of the respective slots 124 and 126, and the internal surfaces of the input/output through-holes 146 are covered with a suitable conductive material, such as for example silver.

Although not shown in any of the FIGURES, it is understood that SMA RF signal input/output co-axial connectors may be coupled to and extend through the respective through-holes 146 in the monoblocks 101 and 107.

As shown in FIGS. 1 and 2, the separate monoblocks 101, 103, 105, and 107 are coupled and secured to each other in an abutting side-by-side relationship as described in more detail below to define and form the waveguide filter 100.

In the embodiment shown, the monoblocks 101 and 103 define the opposed and spaced apart exterior RF signal input/output transmission blocks of the waveguide filter 100 while the monoblocks 105 and 107 are sandwiched or located between the two end blocks 101 and 103 and define the two interior RF signal transmission blocks of the waveguide filter 100.

Specifically, and as shown in FIGS. 1 and 2, the monoblocks 101, 103, 105, and 107 are coupled and secured together in an abutting side by side relationship wherein the longitudinal vertical surfaces 106 of the respective monoblocks 101, 103, 105, and 107 are abutted against each other; the slots 126 on the two interior monoblocks 103 and 105 are co-linearly aligned with each other to define and form an internal or interior elongate slot 135 defined and located in the center of the waveguide filter 100 in a relationship generally normal to the longitudinal axis $L_1$ of the monoblocks 103 and 105 and co-linear with the longitudinal axis $L_2$ of the waveguide filter 100; and the slots 124 in the respective monoblocks 101 and 107 are disposed in a relationship co-linear with the slots 126 and 135 and with the longitudinal axis $L_2$ of the waveguide filter 100.

Thus, in the relationship as shown in FIGS. 1 and 2, the resonators 114, 118, 121, and 123 on the respective monoblocks 101, 103, 105, and 107 define a first row of resonators disposed in a side-by-side relationship and extending along an x-axis and in the same direction as and on one side of the longitudinal axis $L_2$ of the waveguide filter 100; the resonators 116, 120, 122, and 125 on the respective monoblocks 101, 103, 105 and 107 define a second row of resonators disposed in a side-by-side relationship and extending along the x-axis and in the same direction as and on the opposite side of the longitudinal axis $L_2$ of the waveguide filter 100; and the respective pairs of resonators 114 and 116, 118 and 120, 121 and 122, and 123 and 128 define respective columns of resonators disposed in a side-by-side relationship and extending along the Y-axis and in a direction transverse to the longitudinal axis $L_2$. Thus, in the embodiment shown, the blocks 101, 103, 105, and 107, and the respective resonators thereof, are arranged and extend along and in the orthogonal X-Y axis and direction.

The waveguide filter 100 further comprises a first direct coupling RF signal transmission means for transmitting an RF signal directly from the one of the respective RF signal input/output through-holes 146 defining the RF signal input; through the respective resonators 114, 116, 120, 118, 121, 122, 125, and 123 on the respective monoblocks 101, 103, 105, and 107; and then through the other of the respective RF signal input/output through-holes 146.

In the embodiment of FIGS. 1 and 2, the direct-coupling RF signal transmission means comprises respective interior or internal RF signal transmission windows or regions or apertures 622 (FIGS. 2 and 3) defined on respective ones of the longitudinal vertical exterior surfaces 106 of the respective monoblocks 101, 103, 105, and 107 that are aligned with and abutted against each other when the monoblocks 101, 103, 105, and 107 are coupled together to define the direct coupling RF signal transmission means and direct path for the transmission of the RF signal from the resonator 116 in the monoblock 101 into the resonator 120 in the monoblock 103; from the resonator 118 in the monoblock 103 into the resonator 121 in the monoblock 105; and from the resonator 122 in the monoblock 105 into the resonator 125 in the monoblock 107.

In accordance with the embodiment of the invention as shown in FIGS. 1 and 2, the interior or internal RF signal transmission windows 622 comprise generally rectangular-shaped regions on respective ones of the longitudinal vertical exterior surfaces 106 of each of the respective monoblocks 101, 103, 105, and 107 which are devoid of conductive material, i.e., regions of dielectric ceramic material.

Thus, and in view of the above description, it is understood that each of the blocks 101, 103, 105, and 107 includes and defines respective ones of the slots, RF signal transmission bridges, and RF signal transmission windows as described in more detail below.

That is, each of the end RF signal input/output transmission blocks 101 and 103 includes one slot 124 extending into the body thereof from one of the longitudinal vertical exterior surfaces 106 thereof; one RF signal transmission bridge 128 co-linear with the one slot 124; one RF signal transmission window 622 located and defined in the other of the longitudinal vertical exterior surface 106 opposite the longitudinal vertical exterior surface 106 with the slot 124 defined therein; and wherein the RF signal transmission window 622 and the RF signal input/output through-hole 146 are located at opposite ends of the respective blocks 101 and 103 and on opposite sides of the slot 124 and RF signal transmission bridge 128.

Each of the interior RF signal transmission blocks 103 and 105 includes one slot 126 extending into the body thereof from one of the longitudinal vertical exterior surfaces 106 thereof; one RF signal transmission bridge 130 co-linear with the one slot 126; and an RF signal transmission window 622 defined on each of the opposed longitudinal vertical exterior surfaces 106 and located at opposite ends of the respective blocks 103 and 105 and on opposite sides of and spaced from the slot 126 and the RF signal transmission bridge 130.

It is further understood that, in the embodiment of FIGS. 1, 2, and 3, each of the end blocks 101 and 107 and each of the interior blocks 103 and 105 are identical in structure and, more specifically, that in the embodiment of FIGS. 1, 2, and 3, the block 107 is the block 101 flipped over side to side one hundred eighty degrees and further that the block 105 is the block 103 flipped over side to side hundred eighty degrees.

It is still further understood that, in the embodiment of the waveguide filter 100 shown in the FIGURES, the interior or internal RF signal transmission windows 622 are disposed and extend along the longitudinal axis $L_2$ of the waveguide filter 100 in a spaced apart and alternating or staggered relationship on opposite sides of and spaced from the longitudinal axis $L_2$ of the waveguide filter 100 to define a general serpentine or sine wave shaped direct coupling RF signal transmission path through the waveguide filter 100.

The waveguide filter 100 additionally comprises first and second indirect, alternative, or cross-coupling RF signal transmission means which, in the embodiment shown, are in the form of external, cross-coupling/indirect coupling, bypass or alternate RF signal transmission electrodes or bridge members or transmission lines 500 and 501 having a specific impedance and phase and extending between and interconnecting and electrically coupling and interconnecting the respective resonators 114 and 118 of the respective monoblocks 101 and 103, and the respective resonators 121 and 123 of the respective monoblocks 105 and 107.

In the embodiment shown, each of the external cross-coupling transmission lines 500 and 501 includes and is defined by a generally rectangular-shaped substrate or printed circuit board which is seated on and bridges the respective top longitudinal horizontal exterior surfaces 102 of the respective monoblocks 101 and 103 and the respective top longitudinal horizontal exterior surfaces 102 of the respective monoblocks 105 and 107. Each of the external cross-coupling transmission electrodes 500 and 501 additionally includes an elongated strip or line of conductive material 504 (FIG. 2) defined and formed in the interior of the printed circuit board which bridges and extends over the respective resonators 114 and 118 on the respective monoblocks 101 and 103 and over the respective resonators 121 and 123 on the respective monoblocks 105 and 107 and is adapted for electrical connection to the external layer of conductive material on the exterior surface 102 of the respective monoblocks 101, 103, 105, and 107.

Thus, the assembled or finished waveguide filter 100 as shown in the embodiment of FIGS. 1 and 2 comprises a block of dielectric material defining a central longitudinal axis $L_2$; a pair of opposed and spaced-apart top and bottom longitudinal horizontal exterior surfaces 102 defined by the top and bottom longitudinal horizontal exterior surfaces 102 of the respective monoblocks 101, 103, 105, and 107 and extending in the same longitudinal direction as the longitudinal axis $L_2$; a pair of opposed and spaced-apart longitudinal vertical exterior surfaces 110 defined by the transverse vertical exterior surfaces 110 of the respective monoblocks 101, 103, 105, and 107 and extending in the same direction as and spaced from and on opposite sides of the longitudinal axis $L_2$; and a pair of opposed and spaced-apart transverse vertical exterior end surfaces 106 defined by the longitudinal vertical exterior end surface 106 of the monoblock 101 and the vertical exterior end surface 106 of the monoblock 107 respectively and extending in a direction transverse to and intersecting the longitudinal axis $L_2$.

The finished waveguide filter 100 still further comprises the pair of RF signal input/outputs or electrodes defined in part by the pair of RF signal input/output through-holes 146 which extend through the body and dielectric material of the block in a relationship and direction generally normal to the longitudinal axis $L_2$ and terminating in respective openings in the top and bottom exterior block surfaces 102 respectively.

In the embodiment of FIGS. 1 and 2, the first of the pair of through-holes 146 is located and defined in a lower corner of the block of dielectric material located below and spaced from the longitudinal axis $L_2$, while the second of the pair of through-holes 146 is located and defined in a lower diametrically opposed corner of the block of dielectric material below and spaced from the longitudinal axis $L_2$ and co-linear with the first one of the pair of through-holes 146.

The waveguide filter 100 still further comprises and defines the pair of elongate slots 124 defined by the slots 124 formed in the respective monoblocks 101 and 107 and extending from the respective opposed outside transverse vertical surfaces 106 into the body and dielectric material of the block of dielectric material in a relationship generally co-linear with and intersecting the longitudinal axis $L_2$ of the waveguide filter 100. The slots 124 extend between and through the top and bottom longitudinal horizontal exterior surfaces 102 and respective transverse end surfaces 106 of the waveguide filter 100.

The waveguide filter 100 still further comprises and defines the interior slot 135 defined by the slots 126 in the monoblocks 103 and 105 and extending through the body and dielectric material of the block in a relationship generally co-linear with the longitudinal axis $L_2$.

The slots 124 and 135 defined in the block of the waveguide filter 100 are all positioned in a co-linear and spaced apart relationship relative to each other and in a co-linear relationship relative to the longitudinal axis $L_2$.

In the embodiment of FIGS. 1 and 2, the cross-coupling RF signal transmission lines 500 and 501 are both located below, spaced from, and parallel to the slots 124 and 135 and the longitudinal axis $L_2$.

In the embodiment of FIGS. 1 and 2, all of the exterior surfaces 102, 106, and 110; the interior surface of each of the slots 124 and 135; and the interior surface of each of the RF signal input/output through-holes 146 are covered with a layer of conductive material.

Additionally, in the embodiment of FIGS. 1 and 2, a plurality of interior layers or walls 700 of conductive material extend vertically through the full width and height of the body of the block of the waveguide filter 100 in a spaced apart and parallel relationship relative to each other and in a relationship generally transverse and intersecting the longitudinal axis $L_2$. Specifically, a layer or wall 700 of conductive material is located the monoblocks 101 and 103, between the monoblocks 103 and 105, and between the monoblocks 105 and 107. In the embodiment shown, the layer of conductive material on the longitudinal vertical exterior surface 106 of each of the monoblocks 101, 103, 105, and 107 defines each of the interior layers 700 of conductive material in the waveguide filter 100 when the monoblocks 101, 103, 105, and 107 have been coupled together.

In accordance with the invention, the waveguide filter 100 defines a first magnetic or inductive generally serpentine or sine wave shaped direct coupling RF signal transmission path for RF signals generally designated by the arrows d in FIG. 2 successively through the RF signal transmission input through-hole 146; the resonator 114 and, more specifically, the resonator 114 in the monoblock 101; and into the resonator 116 of the waveguide filter 100 and, more specifically, the resonator 116 in the monoblock 101 via and through the RF signal bridge 128 between and interconnecting the resonators 114 and 116 and extending in a relationship generally co-linear with the longitudinal axis $L_2$.

Thereafter, the RF signal is transmitted from the resonator 116 into the resonator 120 of the waveguide filter 100 and, more specifically, into the resonator 120 of the monoblock 103 via the direct coupling RF signal transmission means defined by the interior RF signal transmission window 622 defined in the interior of the waveguide filter 100 between and interconnecting the resonators 116 and 120; and then through the resonator 118 in the waveguide filter 100 and, more specifically, through the resonator 118 in the monoblock 103 via and through the RF signal bridge 130 between and interconnecting the resonators 120 and 118 and extending in a relationship generally co-linear with the longitudinal axis $L_2$.

Thereafter, the RF signal is transmitted from the resonator 118 into the resonator 121 of the waveguide filter 100 via the direct coupling RF signal transmission means defined by the interior RF signal transmission window 622 defined in the interior of the waveguide filter 100 between the resonators 118 and 121 and then into the resonator 122 of the waveguide filter 100 and, more specifically, the resonator 122 in the monoblock 103 via and through the RF signal bridge 130 between and interconnecting the resonators 121 and 122 and extending in a relationship generally co-linear with the longitudinal axis $L_2$.

Thereafter, the RF signal is transmitted from the resonator 122 into the resonator 125 of the waveguide filter 100 and, more specifically, the resonator 125 of the monoblock 107 via the direct coupling RF signal transmission means defined by the interior RF signal transmission window 622 between the resonators 122 and 125 and then into the resonator 123 of the waveguide filter 100 and, more specifically, the resonator 123 in the monoblock 107 via and through the RF signal bridge 128 between and interconnecting the resonators 125 and 123 and extending in a relationship generally co-linear with the longitudinal axis $L_2$.

Thereafter, the RF signal passes through the RF signal transmission output through-hole 146 defined in the waveguide filter 100 and, more specifically, defined in the resonator 123 of the monoblock 107.

In accordance with this embodiment of the present invention, the waveguide filter 100 also defines and provides an alternate or indirect- or cross-coupling RF signal transmission paths for RF signals generally designated by the arrows c in FIG. 2.

One of the cross-coupling or indirect electrical field/capacitive RF signal transmission paths c is defined and created by the external RF signal transmission line 500 which allows for the transmission of a small portion of the direct RF signal being transmitted through the resonator 114 of the waveguide filter 100, and more specifically, the resonator 114 of the monoblock 101, to be transmitted directly into the resonator 118 of the waveguide filter 100, and more specifically the resonator 118 of the monoblock 103, via the interior or internal strip of conductive material 504 which bridges and electrically interconnects the respective resonators 114 and 118 of the waveguide filter 100 and, more specifically, the resonators 114 and 118 of the respective monoblocks 101 and 103.

The other cross-coupling or indirect magnetic/inductive RF signal transmission path c is defined and created by the other external RF signal transmission line 501 which allows for the transmission of a small portion of the direct RF signal being transmitted through the resonator 121 of the waveguide filter 100 and, more specifically, the resonator 121 of the monoblock 105 to be transmitted directly into the resonator 123 of the waveguide filter 100 and, more specifically, the resonator 123 of the monoblock 107.

Figure 8:
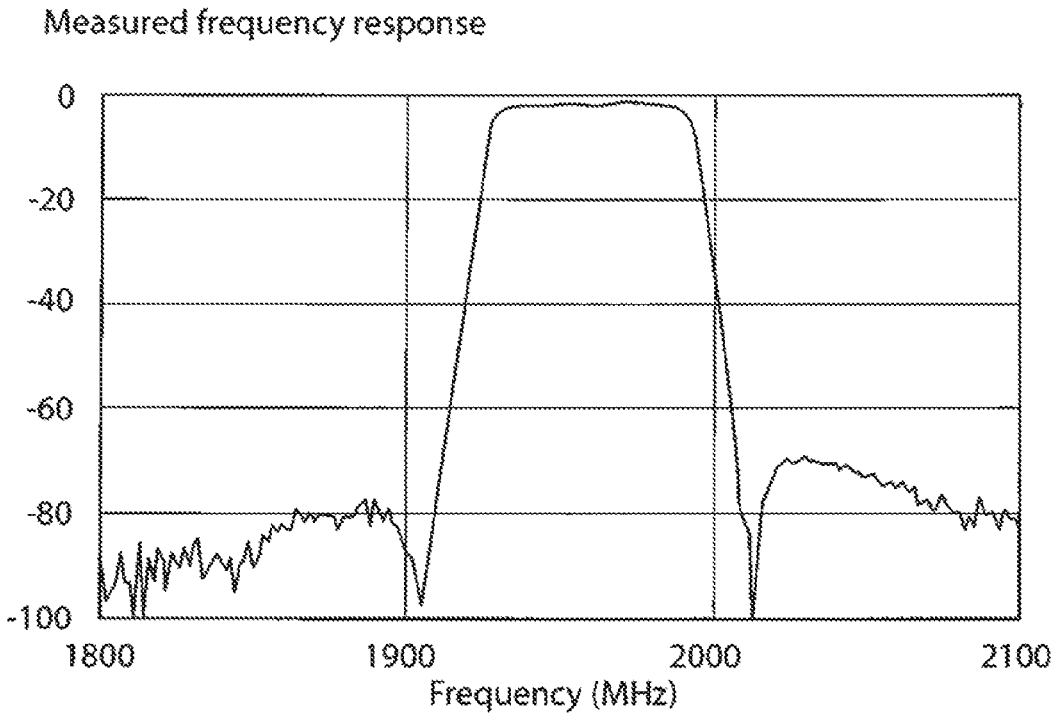
FIG. 8 is a graph representing the performance/frequency response of the ceramic dielectric waveguide filters depicted in FIGS. 1-7.

In accordance with the invention, the cross-coupling of the RF signal as described above advantageously creates respective first and second pairs of transmission zeros, the first pair of which will be located below the passband of the waveguide filter 100 and the second pair of which will be located above the passband of the waveguide filter 100 as shown in FIG. 8 which is a graph of the performance/frequency response of the waveguide filter 100 shown in FIGS. 1 and 2 in which Attenuation (measured in dB) is shown along the vertical or Y axis and Frequency (measured in MHz) is shown along the horizontal or X axis.

FIGS. 4, 5, 6, and 7 depict another embodiment of a waveguide filter 200 in accordance with the present invention which is identical in structure and function to the waveguide filter 100 with the exception that the two end monoblocks 101 and 107 of the waveguide filter 100 have been substituted in the waveguide filter 200 with two end monoblocks **101*a* and 107*a* which are similar in structure and function to the two end monoblocks 101 and 107 except that the two end monoblocks 101*a* and 107*a* additionally include respective notches or steps 236 and 238 as described in more detail below. In view of the above, the earlier description of the structure and function of the waveguide filter 100 and the respective monoblocks 101, 103, 105, and 107 defining the same is incorporated herein by reference with respect to the waveguide filter 200 and the respective monoblocks 101*a*, 103, 105, and 107*a*** defining the same except as otherwise discussed below.

More specifically, the monoblocks **101*a* and 107*a* additionally comprise and define end steps or notches 236 and 238 respectively and each comprising, in the embodiment shown, a generally L-shaped recessed or grooved or shouldered or notched region or section of the lower longitudinal horizontal exterior surface 102, opposed longitudinal vertical exterior surfaces 106, and end transverse surface 110 of the respective monoblocks 101*a* and 107*a*, and more specifically of the respective end resonators 114 and 123**, from which dielectric ceramic material has been removed or is absent.

Stated another way, the respective steps 236 and 238 are defined in and by an end section or region of each of the respective monoblocks 101*a* and 107*a*, and more specifically the respective end resonators 114 and 123, having a height less than the height of the remainder of the respective monoblocks 101*a* and 107*a*.

Stated yet another way, and referring to FIGS. 4, 5, 6, and 7, the respective steps 236 and 238 each comprise a generally L-shaped recessed or notched portion of the respective end resonators 114 and 123 defined on the respective monoblocks 101*a* and 107*a* which includes a first generally horizontal exterior surface 240 located or directed inwardly of, spaced from, and parallel to the lower horizontal exterior surface 102 of the respective monoblocks 101*a* and 103*a* and a second generally vertical surface or wall 242 located or directed inwardly of, spaced from, and parallel to, the transverse exterior end surface 110 of the respective monoblocks 101*a* and 107*a*.

The monoblocks 101*a* and 107*a* additionally each comprise the electrical RF signal input/output electrode in the form of the respective through-holes 146 extending through the body of the respective monoblocks 101*a* and 107*a* in a relationship generally normal to the longitudinal axis $L_1$ thereof and, more specifically, through the respective steps 236 and 238 thereof and, still more specifically, through the body of the respective end resonators 114 and 123 defined in the respective monoblocks 101*a* and 103*a* between, and in relationship generally normal to, the surface 240 of the respective steps 236 and 238 and the surface 104 of the respective monoblocks 101*a* and 103*a*.

Still more specifically, the respective RF signal input/output through-holes 146 are spaced from and generally parallel to the respective transverse side end surface 110 of the respective monoblocks 101*a* and 103*a* and define respective generally circular openings terminating in the step surface 240 and the top monoblock surface 102 respectively of each of the respective monoblocks 101*a* and 107*a*.

The RF signal input/output through-holes 146 are located and positioned in and extend through the interior of the respective monoblocks 101*a* and 107*a* and the respective steps 236 and 238 between and, in a relationship generally spaced from and parallel to, the side end surface 110 and the step wall or surface 242.

In the embodiment shown, the slot 124 in the respective monoblocks 101*a* and 107*a* is located in a relationship spaced, opposed, and generally parallel to, the transverse vertical exterior end surface 110 of the respective monoblocks 101*a* and 107*a*; the respective through-holes 146 in the respective monoblocks 101*a* and 107*a* are located in the respective monoblocks 101*a* and 107*a* between the transverse vertical exterior end surface 110 of the respective monoblocks 101*a* and 107*a* and the slots 124 in the respective monoblocks 101*a* and 107*a*; and the respective steps 236 and 238 and, more specifically, the respective vertical end surfaces 242 thereof, terminate at a point or location short of the respective slots 124, i.e., the respective steps 236 and 238 do not extend into and are spaced from the respective slots 124.

While the invention has been taught with specific reference to the embodiment shown, it is understood that a person of ordinary skill in the art will recognize that changes can be made in form and detail without departing from the spirit and the scope of the invention. The described embodiment is to be considered in all respects only as illustrative and not restrictive.

For example, it is understood that the waveguide filters 100 and 200 can be modified to include fewer than 8 poles or greater than 8 poles by removing or adding additional intermediate resonators/monoblocks along the x-axis between the end resonators/monoblocks that comprise and include the RF signal input/output terminals.

For another example, it is also understood that the waveguide filters 100 and 200 could be modified such that each of the monoblocks comprising the waveguide filter 100 includes and defines additional resonators along the y-axis such as, for example, an embodiment wherein each of the monoblocks defines three resonators separated by two slots and two RF signal transmission bridges.

For another example, it is understood that the waveguide filters 100 and 200 can be modified to include a plurality of monoblocks with resonators that have been stacked on top of each other along and in an x-z orthogonal axes abutting and side-by-side relationship rather than the x-y orthogonal axes abutting and side-by-side relationship of the embodiment of the FIGURES.

For a further example, and as described in incorporated by reference co-pending U.S. patent application Ser. No. 13/373,862, it is understood that the steps 236 and 238 may be of the "step down" or "step in" type disclosed in the FIGURES or of the "step up" or "step out" projection type described in incorporated by reference co-pending U.S. patent application Ser. No. 13/373,862, and that the external bandwidth of the waveguide filter can be adjusted either by increasing or decreasing the size (i.e., the depth or thickness) of the "step down" or "step in" steps or by increasing or decreasing the size (i.e., the height) of the "step up" or "step out" step.

We claim:

1. A waveguide filter for a transmission of an RF signal and comprising:

a pair of solid and separate end blocks of dielectric material each defining at least a pair of resonators, an RF signal transmission input/output transmission electrode, an exterior surface covered with a layer of conductive material, an RF signal transmission window defined by a region of the exterior surface devoid of conductive material and defining a path for the transmission of the RF signal, at least a first open slot extending into the exterior surface and the dielectric material and separating the at least a pair of resonators, and at least a first RF signal transmission bridge of the dielectric material defining a second path for the transmission of the RF signal between the at least a pair of resonators;

one or more solid and separate interior RF signal transmission blocks of the dielectric material each defining at least a second pair of resonators, a second exterior surface covered with a layer of conductive material, a pair of second RF signal transmission windows defined by respective second regions of the second exterior surface devoid of conductive material and defining a third path for the transmission of the RF signal, at least a second open slot extending into the second exterior surface and the dielectric material and separating the at least a second pair of resonators, and at least a second RF signal transmission bridge of the dielectric material defining a fourth path for the transmission of the RF signal between the at least a second pair of resonators; and the pair of solid and separate end blocks of the dielectric material and the one or more solid and separate interior RF signal transmission blocks of the dielectric material being coupled together in a relationship with the exterior surface of the pair of solid and separate end blocks of the dielectric material abutting against the second exterior surface of the one or more solid and separate interior RF signal transmission blocks of the dielectric material; and the combination of the respective RF signal input/output electrodes, the respective at least a pair of resonators, the respective at least a second pair of resonators, the respective at least first and second RF signal transmission bridges, the respective RF signal transmission windows, and the respective pair of second RF signal transmission windows together define a direct path for the transmission of the RF signal through the waveguide filter.

2. The waveguide filter of claim 1 wherein:

each of the pair of solid and separate end blocks of the dielectric material includes a pair of opposed exterior side surfaces, the RF signal transmission window in each of the pair of solid and separate end blocks of dielectric material being defined in one of the respective pair of opposed exterior side surfaces and the respective at least a first open slot being defined in the other of the respective pair of opposed exterior surfaces;

each of the one or more solid and separate interior RF signal transmission blocks of the dielectric material includes a pair of opposed exterior side surfaces, the second pair of RF signal transmission windows being defined in the pair of opposed exterior side surfaces respectively and the respective at least a second open slot being defined in one of the respective pair of opposed exterior side surfaces and located between the respective second pair of RF signal transmission windows, direct path being a generally serpentine shaped path for the transmission of the RF signal.

3. A dielectric waveguide filter comprising:

a pair of solid and separate end blocks of dielectric material and one or more solid and separate interior blocks of dielectric material each including a plurality of exterior side surfaces covered with a layer of conductive material and coupled together to define a plurality of resonators arranged in a side-by-side relationship along at least first and second orthogonal axes;

each of the pair of solid and separate end blocks of dielectric material including an RF signal transmission window defined by a region on one of the plurality of exterior side surfaces devoid of conductive material and at least a first open slot extending into another of the plurality of exterior side surfaces opposed to the respective one of the plurality of exterior side surfaces including the RF signal transmission window;

each of the one or more solid and separate interior blocks of dielectric material including a pair of opposed RF signal transmission windows defined by respective regions on opposed ones of the plurality of exterior side surfaces devoid of conductive material, each of the one or more solid and separate interior blocks of dielectric material including a at least a second open slot extending into one of the opposed ones of the plurality of exterior side surfaces and located between the respective pair of opposed RF signal transmission windows;

first and second RF signal input/output electrodes defined respectively on the pair of solid and separate end blocks of dielectric material;

the pair of solid and separate end blocks of dielectric material and the one or more solid and separate interior blocks of dielectric material being coupled together in a relationship with the one or more solid and separate interior blocks of dielectric material located between the pair of solid and separate end blocks of dielectric material and selected ones of the plurality of exterior side surfaces and RF signal transmission windows of the solid and separate end and interior blocks of dielectric material abutted against each other to define a first direct RF signal path transmission path between the first and second RF signal input/output electrodes, the first direct RF signal transmission path extending in a direction of each of the first and second orthogonal axes; and a first indirect RF signal transmission path between the first and second RF signal input/output electrodes, the first indirect RF signal transmission path extending in the direction of the second axis.

4. The dielectric waveguide filter of claim 3 wherein the first direct RF signal transmission path for the RF signal is generally a serpentine shape.

5. A waveguide filter comprising:

a pair of end blocks each defining at least a pair of resonators and an RF signal transmission input/output transmission electrode;

one or more interior RF signal transmission blocks each defining at least a pair of resonators and located between the pair of end blocks, at least one RF signal transmission bridge defined on each of the pair of end and interior blocks between and interconnecting the respective at least a pair of resonators;

a plurality of interior RF signal transmission windows defined between each of the pair of end interior blocks, the combination of the respective RF signal input/output electrodes, the at least a pair of resonators, the respective at least one RF signal transmission bridges, and the respective plurality of interior RF signal transmission windows together defining a direct path for the transmission of the RF signal through the waveguide filter;

the pair of end and interior blocks comprising separate blocks of dielectric material coupled together in a side-by-side relationship;

the exterior surface of the pair of end and interior blocks being covered with a layer of a conductive material, the respective plurality of interior RF signal transmission windows being defined by regions of the exterior surface of the pair of end and interior blocks which are devoid of conductive material; and an external RF signal transmission line extending between the pair of end blocks and the interior blocks for providing a cross-coupling RF signal transmission path therebetween.

6. The waveguide filter of claim 5 wherein each of the pair of end and interior blocks respectively defines at least one slit in co-linear relationship with the corresponding RF signal transmission bridge.

7. The waveguide filter of claim 6 wherein the respective plurality of RF signal transmission windows are positioned between the pair of end and interior blocks in an alternating and staggered relationship wherein the RF signal is transmitted through the waveguide filter in a serpentine pattern.

8. A dielectric wavequide filter comprising:

a block of dielectric material defining a plurality of resonators arranged in a side-by-side relationship along at least first and second orthogonal axes;

first and second RF signal input/output electrodes defined on the block of dielectric material;

a first direct RF signal path transmission path between the first and second RF signal input/output electrodes, the first direct RF signal transmission path extending in the direction of the first and second axes;

a first indirect RF signal transmission path between the first and second RF signal input/output electrodes, the first indirect RF signal transmission path extending n the direction of the second axis;

the block of dielectric material defining a plurality of internal RF signal transmission windows defining at least a portion of the first direct RF signal transmission path; and the plurality of internal RF signal transmission windows being arranged in an alternating relationship on opposite sides of a longitudinal axis of the waveguide filter to define a generally serpentine-shaped first direct RF signal transmission path.

9. The dielectric waveguide filter of claim 8, wherein an external transmission line defines the first indirect RF signal transmission path.

10. The dielectric waveguide filter of claim 9 wherein the block of dielectric material is comprised of a plurality of separate blocks of dielectric material coupled together in a side-by-side relationship and the first and second orthogonal axes respectively define an x and y axis.

11. A dielectric waveguide filter comprising:

first, second, third, and fourth blocks of dielectric material respectively defining first, second, third, and fourth pluralities of resonators, the first, second, third, and fourth blocks of dielectric material being coupled together in an abutting side-by-side relationship;

first, second, and third direct coupling RF signal transmission windows defined in the interior of the first, second, third, and fourth blocks of dielectric material for transmitting an RF signal from the first block of dielectric material to the fourth block of dielectric material; and first and second external transmission lines extending respectively between the first and second blocks of dielectric material and the third and fourth blocks of dielectric material for providing an indirect cross-coupling between the first and fourth blocks of dielectric material.

12. The dielectric waveguide filter of claim 11 wherein the first and fourth blocks of dielectric material each define an RF signal input/output electrode, the first, second, and third RF signal transmission windows being arranged in a manner for transmitting the RF signal from the first block of dielectric material to the fourth block of dielectric material in a generally serpentine pattern.

13. The dielectric waveguide filter of claim 12 wherein each of the RF signal input/output electrodes is defined by a through-hole extending through each of the first and fourth blocks of dielectric material and further comprising first, second, third, and fourth slot respectively in the first, second, third, and fourth blocks of dielectric material aligned in a co-linear relationship to each other and a longitudinal axis of the waveguide filter and separating the respective first, second, third, and fourth pluralities of resonators.

* * * * *